United States Patent [19]

Geiger

[11] Patent Number: 4,775,053

[45] Date of Patent: Oct. 4, 1988

[54] JEWELRY RACK

[76] Inventor: Richard J. Geiger, 120 E. Sixth St., Fond du Lac, Wis. 54935

[21] Appl. No.: 67,154

[22] Filed: Jun. 29, 1987

[51] Int. Cl.[4] ..... A47F 7/00

[52] U.S. Cl. ..... 211/13; 211/88

[58] Field of Search ..... 211/13, 87, 88, 60.1, 211/133, 41; 206/486, 487, 566; D6/467, 469, 449

[56] References Cited

U.S. PATENT DOCUMENTS

| | | | |
|---|---|---|---|
| D. 93,055 | 8/1934 | Storfer | D6/467 |
| D. 158,547 | 5/1950 | Bassin | 211/13 X |
| D. 287,443 | 12/1986 | Norling | D6/467 |
| 559,744 | 5/1896 | Price | 211/88 X |
| 715,563 | 12/1902 | Doublat | 211/13 X |
| 909,255 | 1/1909 | Thackston | 211/13 X |
| 1,394,947 | 10/1921 | Singer | 211/41 X |
| 1,951,894 | 3/1934 | Ziebarth | 211/13 |
| 2,760,647 | 8/1956 | Saul, Jr. | 211/13 |
| 3,997,050 | 12/1976 | Patterson | 206/566 |
| 4,040,520 | 8/1977 | Joaquin | 211/13 |
| 4,141,453 | 2/1979 | Hanan | 211/13 X |
| 4,324,446 | 4/1982 | LeSage | 206/566 X |
| 4,420,084 | 12/1983 | Whelan | 206/486 X |

*Primary Examiner*—J. Franklin Foss
*Assistant Examiner*—Sarah A. Lechok Eley
*Attorney, Agent, or Firm*—Donald Cayen

[57] ABSTRACT

A jewelry rack comprises a framework of attractive vertical and horizontal wooden bars. The horizontal bars are provided with hooks for hanging such items as rings and necklaces. In one embodiment, the vertical bars are drilled with small holes for receiving the shafts of pierced type earrings. In another embodiment, a block of plastic material covered with cloth is utilized to removably receive the shafts of the pierced type earrings. A mirror may be used in conjunction with the jewelry rack. The horizontal bars are offset so that a lower horizontal bar does not interfere with items hung from a higher bar. The jewelry rack may be hung from a wall, or it may include removable stands for supporting it in an upright attitude on a horizontal surface.

19 Claims, 3 Drawing Sheets

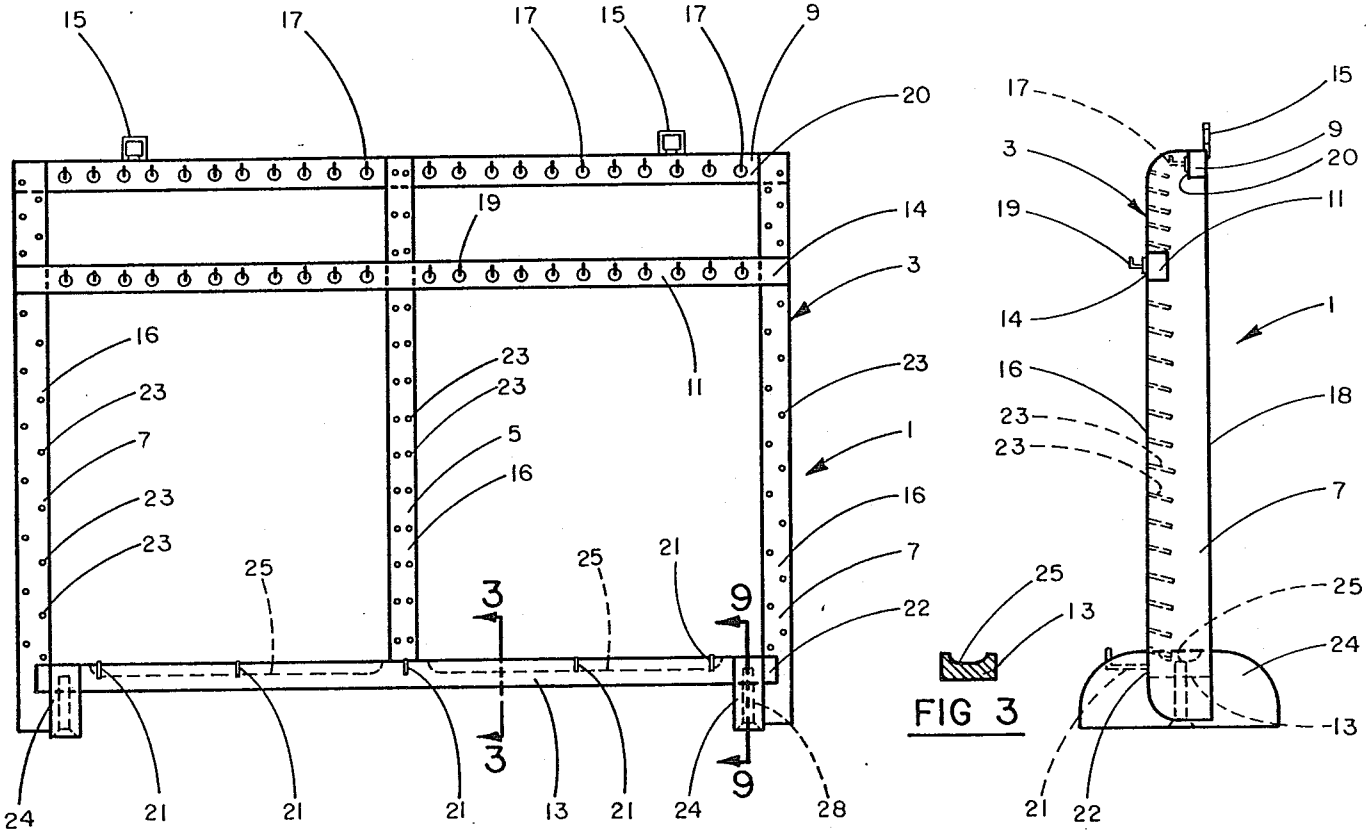
FIG 1
FIG 2
FIG 3
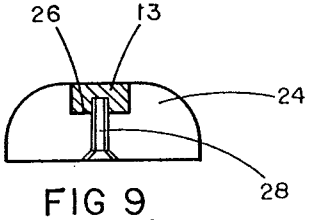
FIG 9

JEWELRY RACK

BACKGROUND OF THE INVENTION

1. Field of the Invention

This invention pertains to storage devices, and more particularly to apparatus for storing articles of jewelry.

2. Description of the Prior Art

The problems associated with neatly storing and arranging pieces of jewelry are well known. Many persons are not satisfied with merely placing their jewelry in a box or drawer.

To solve the jewelry storage problem, various types of storage devices have been developed to hold and display rings, necklaces, and other personal articles. Examples of such storage devices may be seen in U.S. Pat. Nos. 715,563; 4,264,013; and 4,420,084. The garment rack of the U.S. Pat. No. 715,563 patent is specifically designed for use with clothing and umbrellas. The jewelry holder of the U.S. Pat. No. 4,264,013 patent is limited in that it is incapable of holding ladies' earrings. On the other hand, the holding device of the U.S. Pat. No. 4,420,084 is restricted to the storage of earrings. Known jewelry holders are further handicapped in that they are not particularly attractive as permanent additions to a person's room.

Thus, a need exists for a holder that is capable of storing a wider variety of jewelry than is presently available.

SUMMARY OF THE INVENTION

In accordance with the present invention, a jewelry rack is provided that neatly and attractively stores and arranges personal items. This is accomplished by apparatus that includes a framework of interconnected bars in combination with means for holding selected individual jewelry pieces.

The framework bars are arranged in a vertical and horizontal grid. In one embodiment of the invention, the framework comprises three elongated vertical and three horizontal bars. The three vertical bars may be equidistantly spaced. One of the horizontal bars is fixed to each of the three vertical bars at the upper ends thereof, and a second horizontal bar is fixed to the three vertical bars a few inches below the first horizontal bar. Preferably, the first and second horizontal bars are horizontally offset from each other. The third horizontal bar is fixed to the three vertical bars at or near their lower ends. The framework may be hung on a wall, or it may be provided with stands that enable it to be placed upright on a horizontal surface.

To hold rings, bracelets, necklaces, and loop-type earrings on the framework, a series of relatively small hooks are secured to the first and second horizontal bars. The relatively small items such as rings and loop-type earrings are usually placed on to the hooks in the top horizontal bar. Longer items such as necklaces and bracelets may be placed over the hooks of the second horizontal bar, where they hang without hindrance from the third horizontal bar. The third horizontal bar is furnished with a few relatively large hooks for hanging belts and other very long items. Any of the three horizontal bars may be formed with a groove on the top surface thereof to support additional small items, such as cuff links, that are not readily hangable from the hooks.

To store pierced-type earrings, the vertical bars are formed with a number of small holes that are sized to snugly receive the earring shafts. Depending on the shaft lengths, the earring backs may be left on the shafts or placed in the groove of a horizontal bar.

The versatility of the jewelry rack of the present invention is demonstrated by its adaptability to modifications. A particularly decorative embodiment comprises four horizontal bars. The backs of two adjacent horizontal bars and two vertical bars are stepped so as to form a four sided pocket. Inserted into the pocket is a piece of high density Styrofoam plastic material that is covered with a shiny textile material such as nylon or silk. The function of the Styrofoam block is to accept the shafts of pierced type earrings. The material covering the Styrofoam block contributes to a very attractive appearance while simultaneously covering any holes made in the block.

In another embodiment, the present invention comprises a mirror secured to the vertical bars near the upper ends thereof. In that embodiment, the back surfaces of the vertical bars are preferably stepped so that the mirror back is flush with the back surface of the framework.

Other advantages and features of the present invention will become apparent to those skilled in the art upon reading the detailed description of the invention.

BRIEF DESCRIPTION OF THE DRAWINGS

FIG. 1 is a front view of the jewelry rack of the present invention;

FIG. 2 is a side view of the jewelry rack of FIG. 1;

FIG. 3 is a cross sectional view taken along lines 3—3 of FIG. 1;

FIG. 9 is a cross sectional view taken along lines 9—9 of FIG. 1.

DETAILED DESCRIPTION OF THE INVENTION

Figure 5:
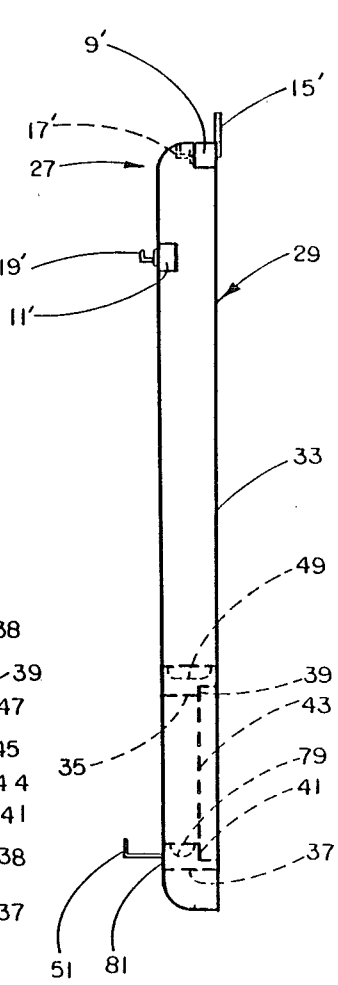
FIG. 5 is a side view of the jewelry rack of FIG. 4.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1 and 2, a jewelry rack 1 is illustrated that includes the present invention. The jewelry rack is particularly useful for storing and displaying items of personal wearing apparel such as rings, earrings, bracelets, necklaces, and belts. Such items are not shown in the drawings, as they are familiar to most persons.

The jewelry rack 1 is comprised of a framework 3 that includes a series of interconnected elongated vertical and horizontal bars. In FIG. 1, three vertical bars and three horizontal bars are illustrated. The vertical bars include a central vertical bar 5 and a pair of side vertical bars 7. Preferably, the side bars 7 are equidistant from the center bar 5. The three horizontal bars include a first bar 9, a second bar 11, and a third bar 13.

The framework 3 may be made of any suitable material, such as a molded plastic. However, I have found that stained and varnished wooden bars create a very attractive accessory for a person's bedroom. With vertical and horizontal bars made of wood, the vertical side bars 5 and 7 may be slotted as shown in FIGS. 1 and 2 to receive the horizontal bars 9, 11, and 13. As best shown in FIG. 2, the front face 14 of the second horizontal bar is flush with the front face 16 of the vertical bars, and the first horizontal bar is horizontally offset from the second horizontal bar toward the framework back surface 18. The bars are preferably fastened to each other by means of a suitable adhesive. To hang the framework on a wall, a pair of hanging hinges 15 may be utilized.

To store and display articles of jewelry, the jewelry rack 1 further comprises a series of hooks. In the illustrated construction, a first row of cup hooks 17 are turned into the front face 20 of the first horizontal bar 9. In a similar manner, a row of cup hooks 19 are turned into the second horizontal bar 11. The cup hooks 17 are suitable for holding such items as rings and loop-type earrings. The hooks 19 of the second horizontal bar 11 may be used to hang necklaces and bracelets. Because the hooks 19 lie in front of the front face 22 of the third horizontal bar 13, long necklaces can be hung from the hooks 19 without hindrance from the third horizontal bar. Of course, the hooks on the first horizontal bar may also be used to hang long items, if desired.

To hang such very long items as belts, the jewelry rack 1 is provided with a series of relatively large hooks 21 that are turned into the third horizontal bar 13. The large hooks 21 are also useful for storing wristwatches.

To store pierced-type earrings, a number of holes 23 are drilled into the front faces 16 of the three vertical bars 5 and 7. The earring shafts are inserted into the holes 23, which have diameters that snugly grip the shafts. For further assurance against dropping and loss, the holes 23 are preferably drilled at an angle of about 10 degrees to the horizontal. To more easily see the holes 23 in darkened rooms, jewelry racks 1 having wooden frameworks 3 may be burned on the front faces 16 in small areas around the holes.

If the pierced type earring shaft is relatively long and the earring back is fairly small, the earring back can be pushed fully onto the shaft and against the earring body, with the shaft exposed for a substantial portion of its length. In that situation, the back can be left on the earring when the shaft is inserted into a hole 23. If the shaft length exposed with the back fully against the earring body is too short to be safely retained in a hole 23, the back is removed from the earring and stored separately. For that purpose, the top surface of the third horizontal bar 13 is fabricated with a pair of grooves 25. In that manner, the third horizontal bar acts as a tray for retaining the earring backs, as well as for other pieces that do not lend themselves to storage by hanging on the hooks 17, 19, or 21.

The jewelry rack 1 may be placed in an upright attitude on a dresser top or other horizontal surface rather than hung on a wall by means of the hangers 15. For standing applications, the jewelry rack includes a pair of stands 24. Each stand 24 has a notch 26 for receiving the framework lowermost horizontal bar 13. The notch 26 may be sized to snugly retain the lowermost horizontal bar without fasteners. Alternately, screws 28 may be employed to securely fasten the stands to the horizontal bar. It is preferable that the stands be located adjacent the vertical side bars 7.

Figure 6:
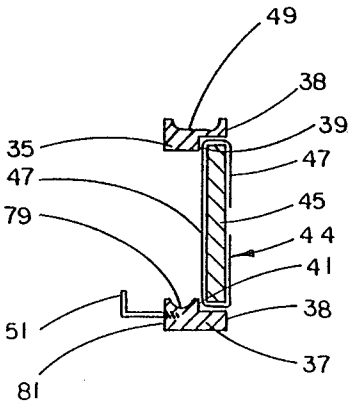
FIG. 6 is a cross sectional view taken along lines 6—6 of FIG. 4.
Figure 4:
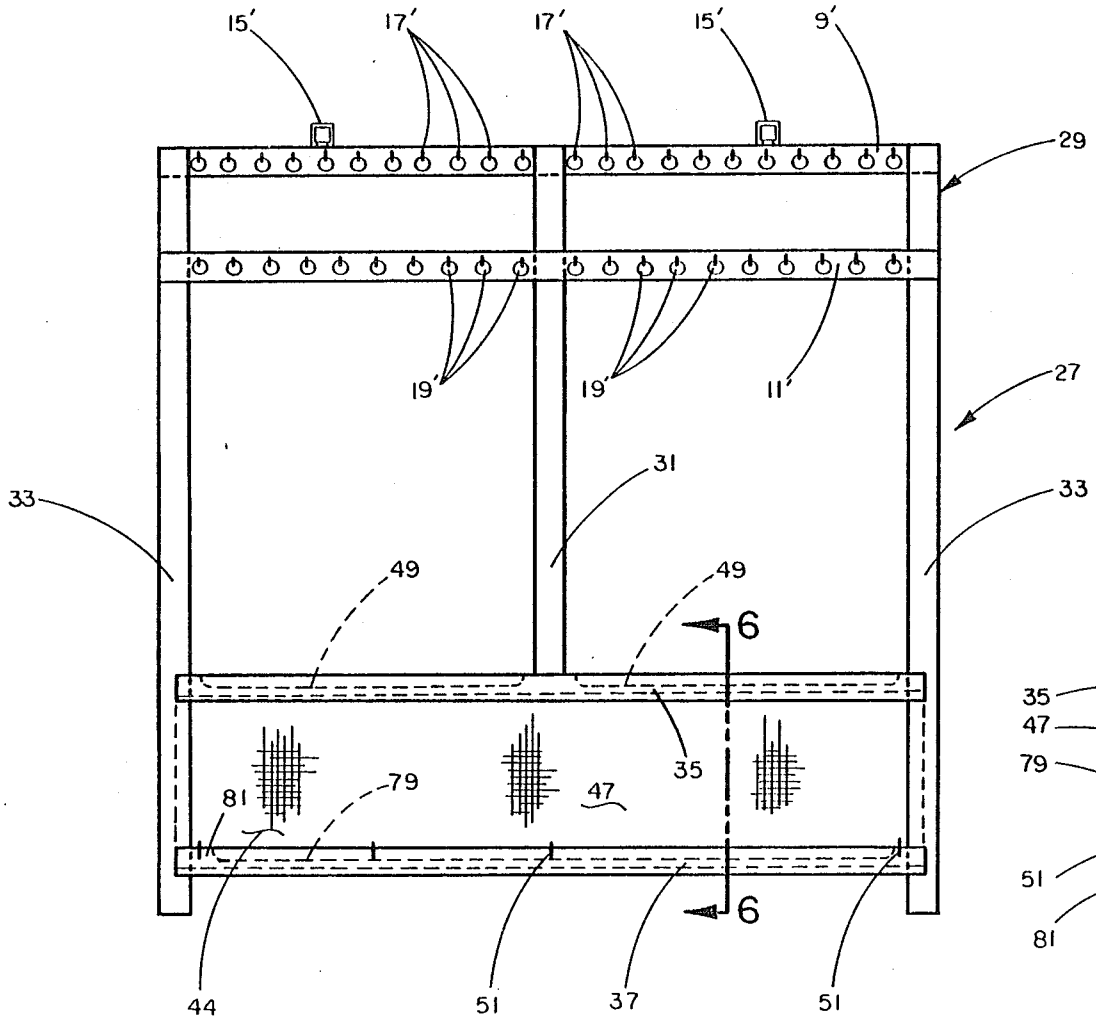
FIG. 4 is a front view of a modified embodiment of the present invention.

Turning to FIGS. 4–6, a modified jewelry rack 27 is depicted. The jewelry rack 27 comprises a framework 29 that includes a central vertical bar 31 and a pair of side vertical bars 33. The framework 29 further comprises a first horizontal bar 9′ and a second horizontal bar 11′ that are similar to the horizontal bars 9 and 11 described previously in connection with FIGS. 1 and 2. Cup hooks 17′ and 19′ are turned into horizontal bars 9′ and 11′, respectively. The jewelry rack 27 may be hung on a wall by means of hinged hangers 15′.

In the illustrated construction, the jewelry rack 27 is manufactured with a third horizontal bar 35 and a fourth horizontal bar 37 that extend between the two side vertical bars 33. As best shown in FIG. 6, the back surfaces 38 of the horizontal bars 35 and 37 are formed with steps 39 and 41, respectively. The steps 39 and 41 match with similar steps in the vertical side bars 33 so as to form a pocket 43.

Inserted into the pocket 43 is an earring panel 44. The earring panel 44 comprises a block 45 of high density Styrofoam plastic material. Wrapped around the block 45 is a cloth 47. For clarity, the cloth 47 is shown in FIG. 6 as being spaced from the block. However, in practice the cloth is wrapped tightly to the block. The cloth margins are bonded to the back of the block with an adhesive such as type PL200 manufactured by Rexnord Chemical Company. The same adhesive may be used to bond the outside edges of the earring panel to the framework 29 within the pocket 43. The preferred material for the cloth is a shiny nylon or silk of a color that matches the decor of the room in which the jewelry rack 27 is hung. The result is a very attractive panel that enhances the aesthetic appeal of the jewelry rack. The function of the earring panel 44 is to receive the shafts of pierced-type earrings. The shafts can be repeatedly pushed into and removed from the block 45 through the cloth 47 without detriment to either component. As with the holes 23 in the jewelry rack 1 described previously, the earring backs may be either left on the earring shafts when inserted into the panel 44, or the backs may be stored in the tray formed by grooves 49 in the third horizontal bar 35.

The jewelry rack 27 includes a number of larger hooks 51 threaded into the fourth horizontal bar 37. The hooks 51 may be identical to and serve the same purpose as the hooks 21 explained with respect to jewelry rack 1 of FIGS. 1–3.

Figure 8:
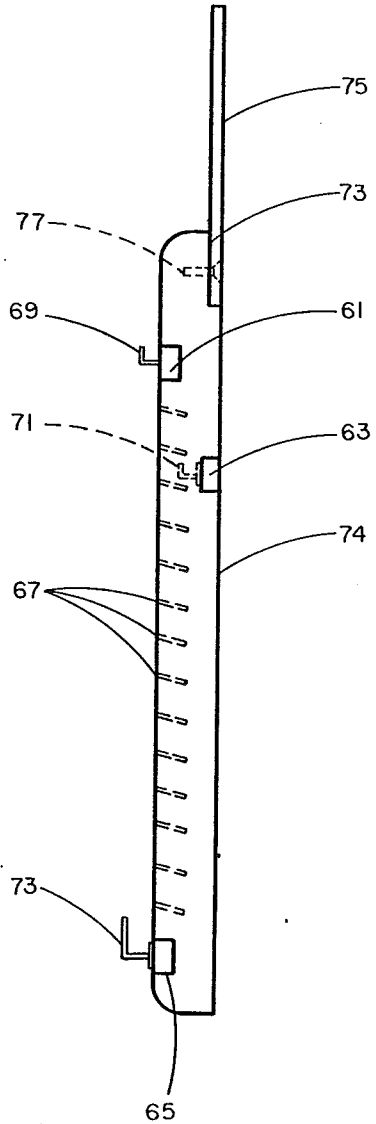
FIG. 8 is a side view of the jewelry rack of FIG. 7.
Figure 7:
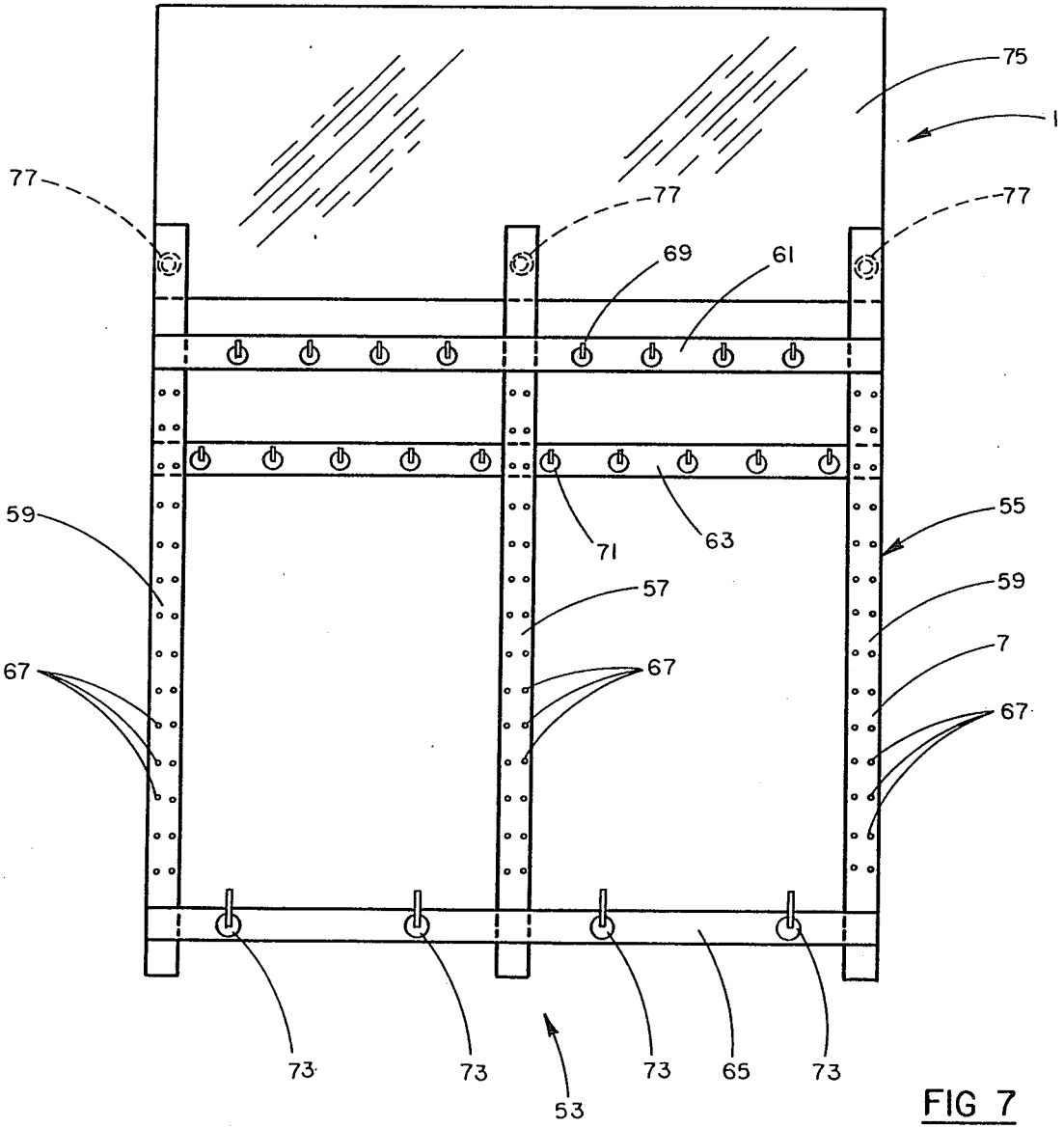
FIG. 7 is a front view of a further modified embodiment of the present invention.

Further in accordance with the present invention, the jewelry rack may include a convenient accessory in the form of a mirror. Turning to FIGS. 7 and 8, a modified jewelry rack 53 is disclosed that has a framework 55 comprised of vertical bars 57 and 59. A first horizontal bar 61 is connected to the three vertical bars 57 and 59 several inches below the upper ends of the vertical bars. The second horizontal bar 63 is attached to the three vertical bars a few inches below the first horizontal bar 61. A third horizontal bar 65 is connected to the three vertical bars at their lower ends. A pattern of holes 67 similar to the holes 23 described in connection with FIGS. 1–3 are drilled into the three vertical bars. The first horizontal bar 61 includes a series of hooks 69, and the second horizontal bar 63 includes a series of hooks 71. The third horizontal bar 65 is furnished with larger hooks 73.

The back surface 74 of the upper ends of the three vertical bars 57 and 59 are formed with respective steps 73. A mirror 75 is placed in the steps 73 and secured to the framework 55 by flathead cap screws 77 through suitable clearance holes that are predrilled in the mirror. If desired, the mirror 75 may be removed without detracting from the appearance or performance of the remainder of the jewelry rack 55. Although not shown in FIGS. 4, 5, 7, and 8, the notched stands 24 as described and shown in connection with FIGS. 1, 2, and 9 may also be used with the jewelry racks of FIGS. 4–8.

Thus, it is apparent that there has been provided, in accordance with the invention, a jewelry rack that fully satisfies the objects, aims, and advantages set forth above. While the invention has been described in conjunction with specific embodiments thereof, it is evident that many alternatives, modifications, and variations will be apparent to those skilled in the art in light of the foregoing description. For example, more or fewer than three vertical bars and horizontal bars may be used, either with or without the earring panel 44. The first horizontal bar may be horizontally offset either backwardly or forwardly of the second horizontal bar, as best seen by comparing FIG. 8 with FIGS. 2 and 5. The number of hooks in the first horizontal bar need not equal the number in the second horizontal bar. The tray for non-hangable pieces may be formed in any horizontal bar. For example, in FIGS. 4–6, a groove 79 may be formed in the horizontal bar 37 between the front face 81 and the earring panel 44. Accordingly, it is intended to embrace all such alternatives, modifications, and variations as fall within the spirit and broad scope of the appended claims.

I claim:

1. A rack for storing small items of jewelry comprising:

a. a framework comprising:

i. a plurality of spaced elongated horizontal bars having respective front faces and upper surfaces; and ii. a plurality of horizontally spaced elongated vertical bars having respective front faces and being interconnected with the horizontal bars, each vertical bar defining a plurality of holes in the front faces thereof having diameters sized to snugly receive the shafts of pierced type earrings; and b. a plurality of hooks turned into the horizontal bars, so that selected jewelry items can be hung on the hooks and the shafts of pierced type earrings can be inserted into and held within the vertical bar holes; wherein the horizontal bars comprise:

c. a first horizontal bar connected to the vertical bars near the upper ends thereof;

d. a second horizontal bar connected to the vertical bars near the lower ends thereof; and e. a third horizontal bar connected to the vertical bars intermediate the first and second horizontal bars, the third horizontal bar being horizontally offset from the first horizontal bar, so that jewelry items can be hung from the hooks on the firat horizontal bar without hindrance from the third horizontal bar.

2. The rack of claim 1 wherein at least one horizontal bar defines a shallow groove in the upper surface thereof, so that the horizontal bar serves as a tray for storing and displaying selected small jewelry items.

3. The jewelry rack of claim 1 further comprising stand means removably joined to the second horizontal bar for selectively enabling the framework to be supported on a horizontal surface or for permitting the jewelry rack to be hung from a vertical wall.

4. A jewelry rack comprising:

a. a framework comprising:

i. a plurality of spaced elongated vertical bars having respective front and back surfaces;

ii. at least one first elongated horizontal bar having a front face and being connected to the vertical bars near the upper ends thereof; and iii. a pair of second horizontal bars having respective front and back surfaces and an upper surface and being arranged into an upper horizontal bar and a lower horizontal bar, the second horizontal bars being connected to the vertical bars near the lower ends thereof, the back surfaces of the second horizontal bars being formed with steps and the back surfaces of the vertical bars being formed with steps that cooperate with the steps in the second horizontal bars to form a pocket in the back of the framework;

b. panel means retained in the framework pocket for releasably receiving selected items of jewelry; and c. a plurality of hooks fastened to the first horizontal bar, so that pierced earrings can be stored in the panel means and other selected jewelry objects can be stored on the hooks.

5. The jewelry rack of claim 4 wherein:

a. the upper bar of the pair of second horizontal bars defines a groove in the top surface thereof; and b. a plurality of hooks are fastened to the lower bar of the pair of second horizontal bars, so that the upper bar of the pair of second horizontal bars serves as a tray for holding selected jewelry items and other selected jewelry items can be hung from the hooks on the lower bar of the second pair of horizontal bars.

6.

The jewelry rack of claim 5 wherein:

a. the framework comprises two first horizontal bars that are vertically spaced apart into upper and lower first horizontal bars and that are interconnected to the vertical bars with the upper first horizontal bar being connected to the vertical bars near the upper ends thereof;

b. the upper and lower first horizontal bars are horizontally offset from each other; and c. a plurality of hooks are fastened to both first horizontal bars, so that jewelry items can be hung from the hooks on the upper first horizontal bar without hindrance from the lower first horizontal bar.

7. The jewelry rack of claim 6 wherein the front face of the lower first horizontal bar is flush with the front surface of the vertical bars and with the front faces of the pair of second horizontal bars, so that selected jewelry items hung from the hooks on the lower first horizontal bar are not hindered by the pair of second horizontal bars.

8. The jewelry rack of claim 4 wherein the panel means comprises:

a. a block of high density plastic material adapted to releasably secure the shafts of pierced-type earrings; and b. a cloth surrounding and bonded to the block of plastic material.

9. The jewelry rack of claim 4 further comprising stand means releasably received on the lower second horizontal bar for enabling the framework to be supported in an upright attitude on a horizontal surface.

10. A jewelry rack comprising:

a. a pair of spaced apart elongated first vertical bars having front and back surfaces;

b. a pair of spaced apart horizontal bars extending between and interconnected with the first vertical bars to form upper and lower first horizontal bars, the first horizontal bars having respective front, back, and upper surfaces, the back surfaces of the first horizontal bars being formed with respective steps, the back surfaces of the first vertical bars lying between the first horizontal bars being formed with respective steps that cooperate with the steps in the first horizontal bars to form a pocket in the vertical and first horizontal bars;

c. a third horizontal bar having a front face and being interconnected to the pair of first vertical bars;

d. a second vertical bar extending between and interconnected with one of the first horizontal bars and the third horizontal bar;

e. panel means retained in the pocket in the first vertical bars and the first horizontal bars for releasably receiving the shafts of pierced-type earrings; and f. a pluality of hooks fastened to the third horizontal bar and to the lower first horizontal bar.

11. The jewelry rack of claim 10 wherein at least one of the first horizontal bars defines a groove in the top surface thereof to create a tray for storing selected items of jewelry.

12. The jewelry rack of claim 10 further comprising:

a. a fourth horizontal bar having a front face and being connected to the vertical bars at a location intermediate the third horizontal bar and the upper first horizontal bar, the third and fourth horizontal bars being horizontally offset from each other; and b. a plurality of hooks fastened to the fourth horizontal bar, so that selected jewelry items can be hung from the third and fourth horizontal bars without hindrance from each other.

13. The jewelry rack of claim 12 wherein the front face of the fourth horizontal bar and the front surfaces of the first horizontal bars are flush with each other, so that selected jewelry items hanging from the hooks of the fourth horizontal bar are not hindered by the first horizontal bars.

14. The jewelry rack of claim 10 wherein the panel means comprises:

a. a block of high density plastic material adapted to releasably secure the shafts of pierced type earrings; and b. a cloth surrounding and bonded to the block of plastic material.

15. A jewelry rack comprising:

a. a plurality of spaced apart elongated vertical bars having upper ends and front and back surfaces, the back surfaces of the upper ends of the vertical bars being formed with respective steps;

b. a plurality of spaced apart elongated horizontal bars having front and back surfaces and being interconnected to the vertical bars and having a lowermost horizontal bar;

c. a plurality of hooks fastened to each of the horizontal bars for hanging selected items of jewelry thereon; and d. a mirror stationarily secured to and extending above the upper ends of the vertical bars, the mirror being secured in the vertical bar steps such that the back of the mirror is flush with the back surfaces of the vertical bars.

16. The jewelry rack of claim 15 wherein the front surfaces of at least two of the horizontal bars are horizontally offset from each other, so that selected jewelry items can be hung from the hooks on a higher horizontal bar without hindrance from the jewelry items hanging from the hooks on a lower horizontal bar.

17. The jewelry rack of claim 14 wherein the vertical bars define a plurality of holes sized to snugly receive the shafts of pierced type earrings.

18. The jewelry rack of claim 17 wherein the holes are drilled into the front surfaces of the vertical bars and make respective angles of approximately 10 degrees with the horizontal.

19. The jewelry rack of claim 15 further comprising stand means releasably joined to the lowermost horizontal bar for selectively supporting the jewelry rack in an upright attitude on a horizontal surface or for permitting the jewelry rack to be hung from a vertical wall.

* * * * *